United States Patent [19]

Böhme

[11] 4,410,173

[45] Oct. 18, 1983

[54] COUNTERBALANCED ROUNDABOUT HAVING PLURAL DRIVES

[75] Inventor: Karl Böhme, Bremen, Fed. Rep. of Germany

[73] Assignee: Heinr. Wilhelm Huss & Co., Fed. Rep. of Germany

[21] Appl. No.: 244,590

[22] Filed: Mar. 17, 1981

[30] Foreign Application Priority Data

Mar. 18, 1980 [DE] Fed. Rep. of Germany ..... 3010302
Mar. 18, 1980 [DE] Fed. Rep. of Germany ... 8007321[U]

[51] Int. Cl.[3] ..... A63G 1/08

[52] U.S. Cl. ..... 272/38; 74/410; 272/49

[58] Field of Search ..... 272/38, 49, 29, 36, 272/7; 74/410

[56] References Cited

U.S. PATENT DOCUMENTS

| | | | |
|---|---|---|---|
| 1,987,004 | 1/1935 | Eyerly | 272/49 |
| 2,229,966 | 1/1941 | Eyerly | 272/38 |
| 2,328,852 | 9/1943 | Shepherd | 272/36 |
| 2,847,216 | 8/1958 | Courtney | 272/49 X |
| 2,931,241 | 4/1960 | Scott | 74/410 |
| 3,456,520 | 7/1969 | Fritsch | 74/410 |
| 3,596,905 | 8/1971 | Brown | 272/29 |
| 3,807,250 | 4/1974 | Dietzel et al. | 74/410 |
| 3,972,527 | 8/1976 | Bacon | 272/38 X |

FOREIGN PATENT DOCUMENTS

| | | | |
|---|---|---|---|
| 425860 | 4/1911 | France | 272/40 |
| 2281145 | 3/1976 | France | 272/29 |
| 963 | of 1898 | United Kingdom | 272/36 |

*Primary Examiner*—Robert A. Hafer
*Assistant Examiner*—Arnold W. Kramer
*Attorney, Agent, or Firm*—Majestic, Gallagher, Parsons & Siebert

[57] ABSTRACT

A roller coaster system with a passenger carriage moved in a vertical plane on a circular path by means of a jib is driven starting from a central boss, with the aid of a concentric gear wheel on which a plurality of pinions act, each of the pinions driven by its own motor. The passenger carriage can be rigidly secured on the jib, so that the passengers are flung over head, or it may be articulated on the free end of the jib, flying laterally, in the manner of a somersault swing. In the latter case, the chain drive for parallel guidance of the passenger carriage can be removed, without dismantling, together with the jib when it is supported on the latter and coupled to a stationary central structural part with the aid of a set of gear wheels.

5 Claims, 8 Drawing Figures

COUNTERBALANCED ROUNDABOUT HAVING PLURAL DRIVES

BACKGROUND OF THE INVENTION

The invention relates to a roller coaster system with a passenger carriage mounted on the free end of a jib rotating and driven about a horizontal axis and movable therewith, a gear wheel secured on the jib and concentric with the axis being driven by a pinion.

In the roller coaster of this type known from U.S. Pat. No. 1,987,004, an electromotor is provided whose drive pinion cooperates with the gear wheel secured on a shaft carrying the jib. In this known roller coaster system, the jib is extended past this drive shaft and carries on its end opposite the passenger carriage a compensating weight the magnitude of which can be modified by variable water charge.

In particular, when no counterweight is provided for compensating all or a portion of the weight of the passenger carriage (for example only the empty weight) whereby the travel performance is approximated to that of a swing—in particular a somersault swing—great forces must be transmitted from the motor drive to the gear wheel, since the diameter ratio between jib and gear wheel is very great. This also applies when the passenger carriage is to be accelerated rapidly into its circular movement without build-up of vibrations. The known device for transmitting the driving power of the motor to the gear wheel would require that the width of the teeth be so great that as a rule a practical execution is impossible.

It is therefore the object of the invention to impel a jib, which is heavily and particularly also eccentrically weighted and rotatable about an axis, in the area of the axis and to provide the required high torque via a gear wheel drive of acceptable dimensions.

SUMMARY OF THE INVENTION

In accordance with the invention, this problem is solved in that a plurality of pinions, each driven by its own motor, acts on the gear wheel. It is thus possible to keep the size of the teeth within normal limits and still transmit considerable driving forces. The elasticity of an oil motor drive or of a direct-current motor, for example, compensates differences in the individual pinions. Further, the hydraulic drive makes it possible to provide for coasting (which may be thrown in preferably at least during the downward travel of the swing basket) with the simplest means, namely with a by-pass to the oil motor or the oil motors, in which a valve opens as soon as the pressure conditions change (during transition to downward travel).

The gear wheel is preferably a component of a ball bearing slewing gear which makes it possible to dispense with a central shaft and a relatively large diameter of the bearings as well as of the gear wheel.

In the event that the above discussed coasting is not provided for, it is preferable for the propulsive output (and possibly also the torque) to be uniform over the entire circular path of the vehicle.

The drive in accordance with the invention may be used successfully in roller coaster systems different from those of the present type. Thus, the passenger carriage may be rigidly secured to the free end of the jib and shaped substantially corresponding to a section of the circular path described by the jib. As a result of the intentional weight reciprocation, movement of the vehicle in the ascending branch is retarded, and it is accelerated in the descending branch. The passengers thus receive the impression of flying in a loop or of traveling in a car. This is the case also when a counterweight is provided on the side of the central rotational axis diametrically opposed to the passenger carriage, the counterweight compensating only the weight of the empty carriage.

That impression of the passengers is enhanced when the carriage overlaps an axis-concentric ring which corresponds substantially to the circular path and is also secured on the jib. When the ball bearing slewing gear is in operation, the persons on the carriage have the impression of sitting in a car and traveling with it along the track formed by the ring. In this case, provision is preferably made that—as just mentioned—the jib extend past the axis to a second jib carrying a counterweight which compensates the weight of the empty carriage, and that the ring be secured also to the second jib.

While in the case of the above described construction of the roller coaster system the passengers are flung over head through the upper region of the circular path, an alternative embodiment of the system in accordance with the invention starts with a passenger carriage articulated to the free end of the jib, so that it is suspended horizontally in all angular positions of the jib; a counterweight on a compensating arm extending from the opposite direction substantially compensates the weight of the passenger carriage. In this instance, which corresponds in principle to the construction known from German OS (laid-open application) No. 25 49 261, it is provided in accordance with the invention that the passenger carriage sit on a cantilever extending axis-parallel away from the jib. In this way, the carriage is completely free from any constructional elements on one side, so that the passengers have the impression of floating freely through the air. This impression is still further enhanced when—as is preferable—the carriage seats are mounted transversely to the swivel axis of the carriage, with the back rests toward the jib. Also in this way, the passengers are provided with a better support which is uniform on both sides, when the roller coaster system travels in a rocking mode (that is with changing direction of rotation).

A further development of this type of roller coaster system with a passenger carriage whose constantly horizontal position is ensured by a chain drive between the swivel axis of the carriage and the resting rotational axis of the jib (German OS No. 25 49 261), consists in that the chain drive is led over a sprocket wheel supported on the jib. A gear wheel is connected with the sprocket wheel and meshes with an intermediate gear wheel which in turn engages a stationary sprocket concentric with the axis of rotation. At least the part of the jib carrying the chain drive with the sprocket wheel and gear wheel is releasably secured on a remaining part comprising the pivot bearing of the jib. Such a construction makes it possible to retain the known chain drive (or comparably operating structural elements) while eliminating the problems hitherto connected with it. These problems were due particularly to the fact that, when attending to the required removal of the jib from the supporting structure (post or the like), the chain had also to be removed. This is cumbersome and dangerous to the extent that damage to the chain results in the inherent danger of later accidents.

With the above described further development, the jib can be substantially dismantled and re-assembled without touching the chain drive. It is immaterial whether the intermediate wheel effecting the required reversal of movement belongs to the dismantled part of the jib, or whether it stays on the support with the remaining part.

Protection of the chain drive can be improved still further by enclosing it in the housing-like part of the jib. At the same time, the chain drive is thereby removed from the view of the passengers, and the interior of the jib which, for reasons of static practicability, is in the form of a hollow chest, is suitably utilized.

DETAILED DESCRIPTION OF THE DRAWINGS

Figure 2:
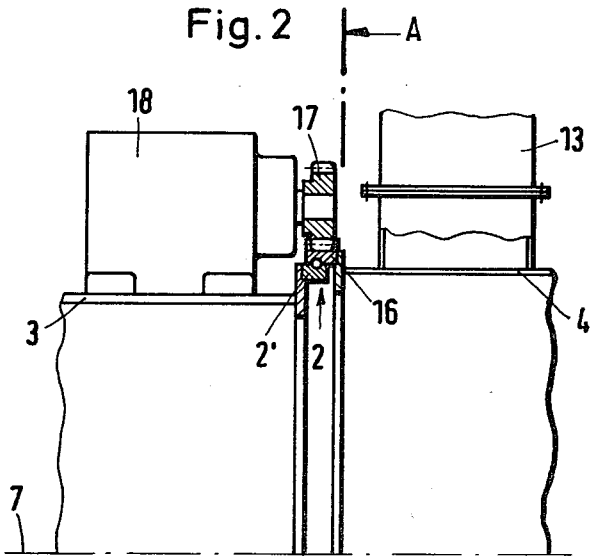
FIG. 2 is a partial section through the drive arrangement along line II—II of FIG. 1.
Figure 1:
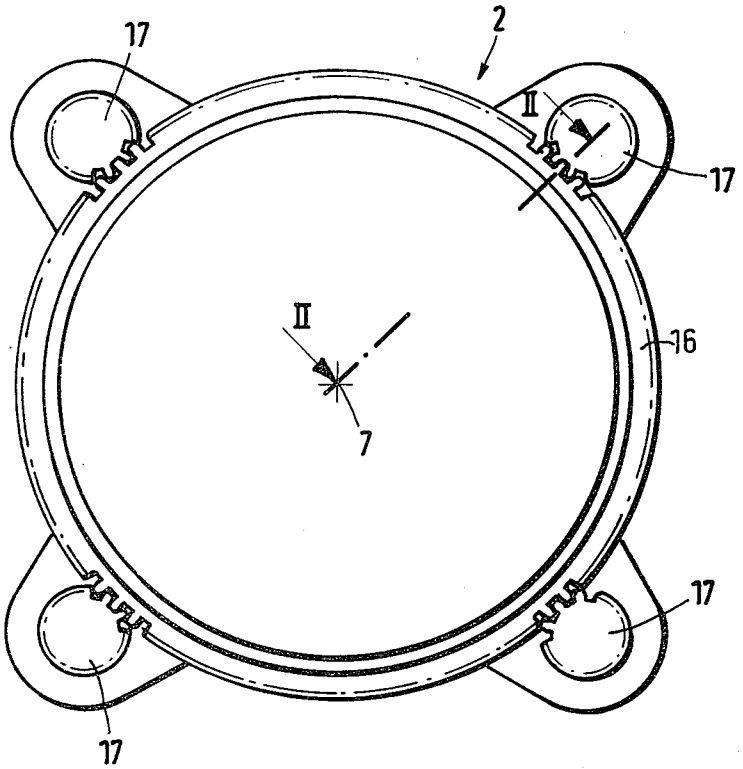
FIG. 1 is a schematic view of the drive arrangement in accordance with the invention in direction of the arrow A in FIG. 2.

A support 1 or 101 (FIGS. 3-6), whose structural details are unimportant in the present context, carries on its upper free end—pointing sideways—the stationary part 3 of the drive unit and the ball bearing slewing gear shown in greater detail in FIGS. 1 and 2. The jib 8 (FIGS. 3 and 4) or 108 (FIGS. 5 and 6) is secured to the part of the ball bearing slewing gear 2 rotating about the axis 7, namely a boss 4.

Figure 4:
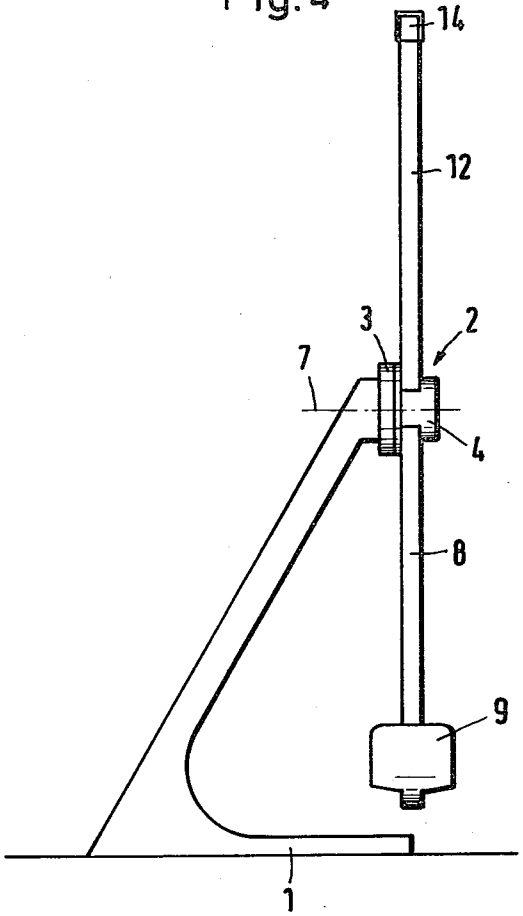
FIG. 4 is also a schematic view of this embodiment, seen from the side.

The supporting structure 1 may also comprise a carriage with a plurality of pairs of wheels, to which an axle carrier is articulated. The carrier can be raised after each roller coaster trip with the aid of a multistage telescope cylinder. The arrangement (as shown in FIG. 4) can be such that the axle carrier need not be swung into its vertical position; this enables passengers boarding in front to leave in the back. In its operational position, this type of axle carrier is reinforced by hinged supports.

FIGS. 1 and 2 illustrate the drive arrangement in accordance with the invention which is common to the two embodiments shown in FIGS. 3 and 4, and 5 and 6, respectively. The inner ring 2' of the gear is—as is most clearly seen in FIG. 2—secured to the stationary part 3 of the drive unit. The outer ring of the gear 2 is in the form of an outer gear wheel 16. Four pinions 17 engage in the toothed rim and are each driven by a separate motor 18, for example an oil motor. The motors 18 are secured on the stationary part 3 of the drive unit and suitably connected together as well as with the power supply and the controls.

Figure 3:
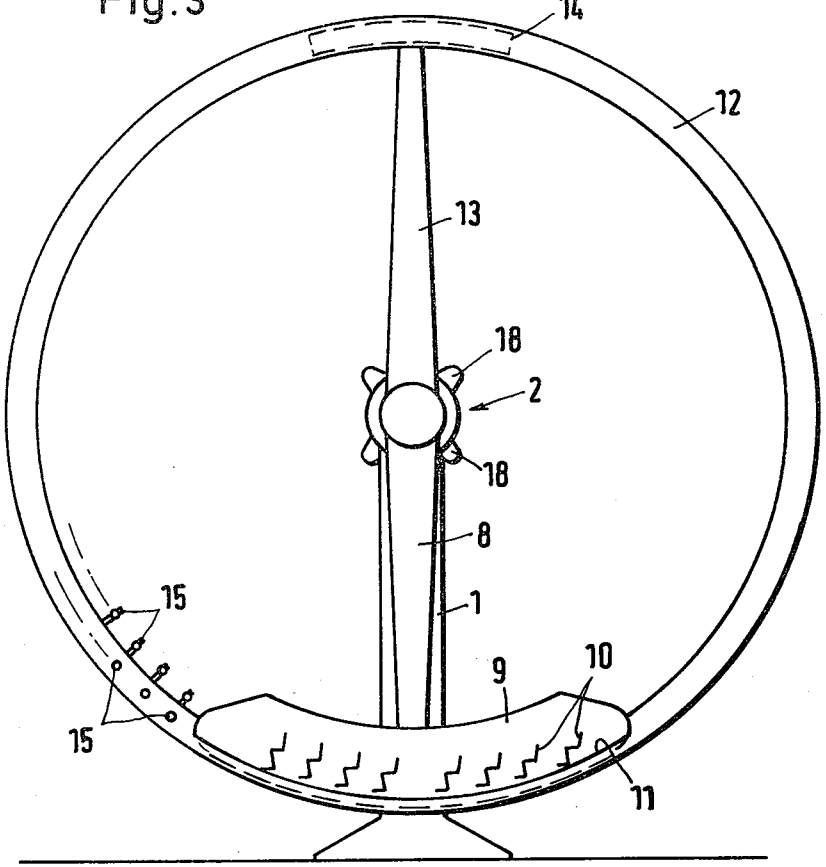
FIG. 3 is a schematic view of a roller coaster system seen from the front.

In the embodiment of FIGS. 3 and 4, a passenger carriage 9 is rigidly secured on the free end of the jib 8. It (that is, primarily its bottom 11 carrying the seats 10) is in the shape of a section of the circular path over which it sweeps during rotation of the jib 8 about the axis 7. Further, the carriage 9 overlaps—at least seemingly—a track ring 12 which is also secured on the free end of the jib 8 and also, diametrically opposite the axis, to the free end of a second jib 13 which extends the jib 8 past the axis 7. The ring 12 thus rotates with the jibs 8 and 13 when the latter are rotationally driven about the axis 7 via the gear 2.

The cross-section of the ring 12 is selected so that the passengers on the seats 10 in the carriage 9 have the impression as if they were sitting in a car rolling along a track. The term "overlapping" in the present context also means engagement in the ring 12 as well as any other relative position allowing connection of the carriage 9 or the jib 8 with the ring 12.

A counterweight 14 compensating the weight of the empty carriage 9 is provided in the region of the free end of the second jib 13. Numeral 15 indicates chains of light sources secured on the ring 12.

Figure 6:
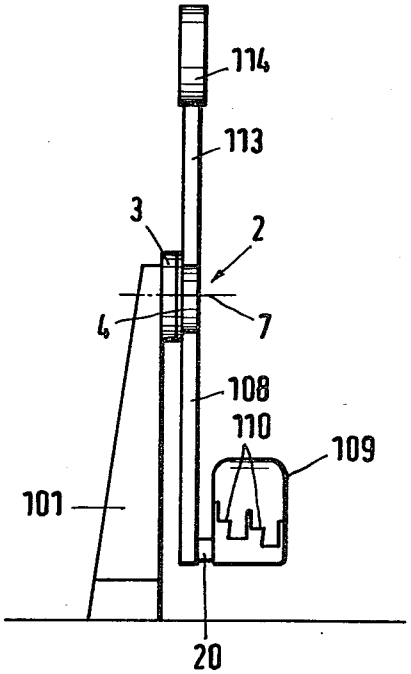
FIG. 6 is also a schematic view of this embodiment, seen from the side.
Figure 5:
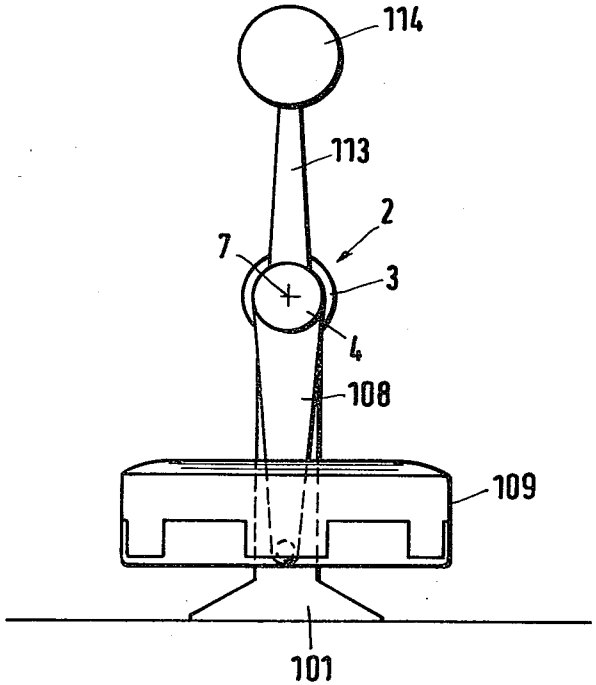
FIG. 5 is a schematic view of another embodiment of the roller coaster system, seen from the front.

FIGS. 5 and 6 illustrate another embodiment. The structural parts corresponding to those of the previously described embodiment, but structurally different in the present figures, are designated by numerals raised by 100. The structural support 101 carries the drive unit in accordance with the invention with the ball bearing slewing gear 2 between the stationary part and the boss 4. The jib 108 carrying the passenger carriage 109 and the second jib 113 carrying the counterweight 114 are both secured to the boss 4.

Figure 8:
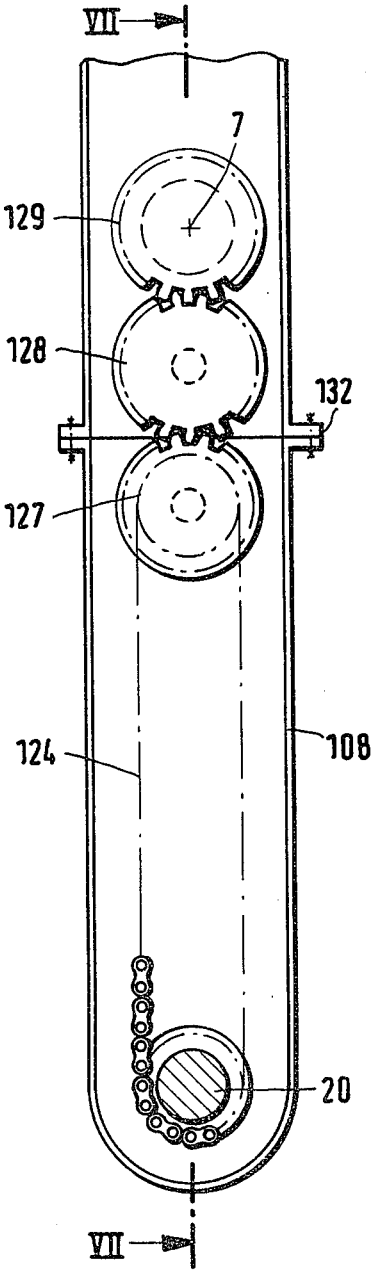
FIG. 8 is a corresponding front view of FIG. 7.
Figure 7:
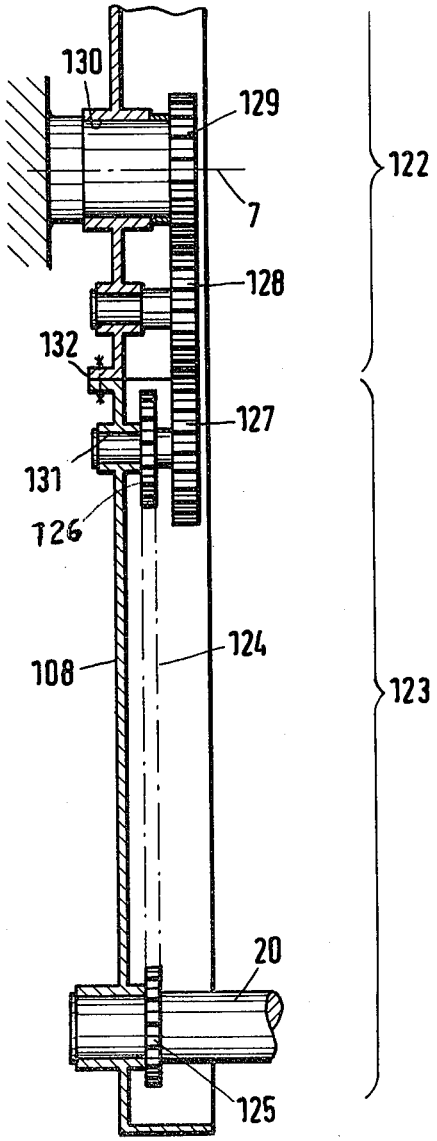
FIG. 7 is a section along line VII—VII of FIG. 8, on an enlarged scale, of a jib with the parallel guide for the passenger carriage in accordance with the invention.

The carriage 109 is hinged to the jib 108 with the aid of a cantilever 20 approximately at the level of the passenger seats 110, so that it remains in horizontal position in all rotational positions of the jib 108 (comp. FIGS. 7 and 8). FIG. 6 makes it clear that the seats 110 are disposed with their back rests toward the jib 108, in a plurality of rows which are offset stepwise in relation to each other, the uppermost row being disposed next to the jib 108.

FIGS. 7 and 8 show an embodiment of the invention for the parallel arrangement of the carriage 109 on the jib 108, the illustration being schematic and omitting the drive unit.

The cantilever 20 holding the passenger carriage 109 (not shown here) is supported on the jib 108 in the form of a pivot and carries a chain wheel 125 over which a chain 124 travels. The counter-chain wheel 126 together with a gear wheel 127 are secured on a pivot 131 which is also supported on the jib 108. The jib 108 is divided at 132 substantially tangentially to the divided circle of the gear wheel 127. The part 123 with the chain drive 124 through 126 can be removed from the remaining part 122 by loosening bolts or the like, the entire chain drive remaining on the part 123.

When the part 123 is re-attached, the gear wheel 127 comes into engagement with an intermediate gear wheel 128 supported on the part 122 of the jib 108. The gear wheel 128 in turn meshes with a stationary gear wheel 129 which is secured concentrically with the axis 7 on a structural part which in the present example is shown in the form of a stationary axle. The rest portion 122 of the jib 108 is rotatable by means of the journal 130.

When the jib 108 comprising the parts 122 and 123 (if desired with a corresponding second jib on the other side of the axis 7) is made to rotate in a manner not shown, the intermediate wheel 128 rolls off on the gear wheel 129 and imparts rotational movement to the gear wheel 127 (which is of the same size as the gear wheel 129). This movement is transmitted by the chain drive 124 through 126 to the cantilever 20 and thereby to the passenger carriage 109. The angle of rotation of the carriage here corresponds to the opposite of that of the jib 108, so that the carriage 109 is maintained in horizontal position at all times. When the roller coaster is taken apart and put together again, with removal and reattachment of (most of) the jib 108, the chain drive insuring this relative position need not be touched.

It is therefore also possible to enclose the chain drive 124 through 126 practically completely in a jib 108 which is in the form of a closed housing. It is of course possible—as will be easily understood—to dispose the point 132 of connection between the parts 122 and 123 of the jib 108 in the region where the gear wheels 128 and 129 engage, so that the intermediate wheel 128 is also supported on the part 123.

I claim:

1. An amusement ride, comprising:

a supporting structure;

a single passenger carriage carried by one end of a first jib, said carriage having a plurality of rows of passenger seats, another end of said jib being pivotably mounted to said support in a manner to rotate about a fixed horizontal axis, a second jib having a counterweight rigidly attached to one end and another end thereof being rigidly connected to said first jib in a manner to rotate therewith about said axis with said counterweight opposite the passenger cage, said counterweight being positioned and with a fixed weight that substantially counterbalances the passenger carriage when empty, a gear wheel operably attached to said first and second jibs with an axis of rotation coincident with said horizontal axis, and at least four motors carried by said supporting structure, each motor driving a pinion gear that engages said gear wheel at locations spaced therearound thereby to rotate said jibs and passenger carriage in a manner to reduce the strain when said carriage is heavily loaded with passengers.

2. The amusement ride according to claim 1 wherein said gear wheel comprises a ring having gear teeth carried by an outside circumferential surface thereof, said ring being rotatably carried through an inside circumferential surface thereof by said supporting structure.

3. The amusement ride according to claim 1 wherein said carriage is pivotably mounted to said first jib through a horizontal cantelever so that it remains horizontal for all rotatable positions of said first jib.

4. The amusement ride according to claim 1 wherein said carriage is pivotably mounted to said first jib so that it remains horizontal for all rotatable positions of said first jib, and further wherein said seats are mounted with backrests thereof facing toward said first hib, wherein passengers seated in said seats face away from said first jib.

5. The amusement ride according to claim 4 wherein said rows of seats are arranged in stepped elevations with respect to each other, the uppermost row being disposed closest to said first jib.

* * * * *